US006938359B2

(12) United States Patent
Birgersson et al.

(10) Patent No.: US 6,938,359 B2
(45) Date of Patent: Sep. 6, 2005

(54) METHOD FOR CONTROLLING DRYING OF A WEB-FORMED MATERIAL

(75) Inventors: Jonas Birgersson, Växjö (SE); Per Holmberg, Växjö (SE)

(73) Assignee: Andritz Technology and Asset Management GmbH (AT)

( * ) Notice: Subject to any disclaimer, the term of this patent is extended or adjusted under 35 U.S.C. 154(b) by 0 days.

(21) Appl. No.: 10/467,074

(22) PCT Filed: Jan. 16, 2002

(86) PCT No.: PCT/SE02/00065

§ 371 (c)(1),
(2), (4) Date: Aug. 5, 2003

(87) PCT Pub. No.: WO02/063098

PCT Pub. Date: Aug. 15, 2002

(65) Prior Publication Data

US 2004/0064967 A1 Apr. 8, 2004

(30) Foreign Application Priority Data

Feb. 5, 2001 (SE) ..... 0100339

(51) Int. Cl.[7] ..... F26B 3/00

(52) U.S. Cl. ..... 34/445; 34/446; 34/487; 34/491; 34/492

(58) Field of Search ..... 34/445, 446, 487, 34/491, 492, 493, 494, 495, 496, 524, 528, 543, 546

(56) References Cited

U.S. PATENT DOCUMENTS 3,161,482 A * 12/1964 Gschwind et al. ..... 34/570
4,696,115 A * 9/1987 Spadafora ..... 34/524
4,719,708 A 1/1988 Karlsson et al.
5,136,790 A 8/1992 Hagen et al.

FOREIGN PATENT DOCUMENTS

SE 514397 2/2001

* cited by examiner

*Primary Examiner*—Jiping Lu
(74) *Attorney, Agent, or Firm*—Swidler Berlin LLP

(57) ABSTRACT

A web-formed material (1), preferably a pulp web (1), is passed through a drying plant, comprising blow boxes arranged in a plurality of drying decks, floating above lower blow boxes, which at their upper sides blow out hot process air against the web-formed material (1). Water, in the form of steam, escaping from the web-formed material (1) is discharged by the process air, at least part of which is recirculated (43) whereas the non-recirculated process air is discharged as exhaust air (41) and is replaced by a corresponding portion of supply air (42) with a low water content. The temperature of the process air is controlled (4). If a deviation from the desired dry content of the dried web-formed material (1) is detected (6), the volume flow of the process air (40) is changed by increasing the volume flow of the process air (40) at too low a dry content in the web-formed material (1), and by decreasing the volume flow of the process air (40) at too high a dry content in the web-formed material, for the purpose of rapidly regaining the desired dry content of the dried web-formed material (1).

12 Claims, 2 Drawing Sheets

METHOD FOR CONTROLLING DRYING OF A WEB-FORMED MATERIAL

TECHNICAL FIELD

The present invention relates to a method for controlling drying of a web-formed material, preferably a pulp web. The web-formed material is passed through a drying plant, comprising blow boxes arranged in a plurality of drying decks, floating above lower blow boxes, which at their upper sides blow out hot process air against the web-formed material, in order to dry this, preferably in such a way that aerodynamic forces retain the web-formed material stably floating at an approximately constant distance above the lower blow boxes.

Water, in the form of steam, escaping from the web-formed material is mixed with and discharged by the process air, at least part of which is recirculated whereas the non-recirculated process air is discharged as exhaust air and is replaced by a corresponding portion of hot supply air with a low water content. The temperature of the process air is controlled by supplying heat to the recirculated process air.

BACKGROUND ART

In the contactless drying of a web-formed material, for example pulp, the web-formed material is moved back and forth through a plurality of drying decks with intermediate turning rolls. The drying decks comprise lower blow boxes which at their upper sides blow out process air and usually also upper blow boxes which at their lower sides blow out process air. Usually, the lower blow boxes are designed in such a way that they provide a fixed, stable position for the web-formed material above the lower blow boxes whereas the blow-out from the upper blow boxes occurs perpendicular to the web. The process air from the lower blow boxes thus have a twofold purpose. In addition to drying the web, a stable web run is to be achieved. The only task of the process air from the upper blow boxes is to dry the web-formed material.

In the control of the drying, there are essentially three parameters. The moisture content, the temperature and the volume flow of the process air may be influenced.

The water which escapes from the web-formed material in the form of steam is mixed with and discharged by the process air. To be able to maintain the drying power, part of the process air must therefore be discharged as exhaust air and be replaced by drier, and preferably hot, supply air. This normally occurs to such a limited extent that such a high moisture content in the exhaust air is maintained that condensation and corrosion on exposed parts may only just be avoided. The main part of the process air is recirculated. The volume of exhaust air, corresponding to the discharged volume of process air, other air introduced and any leaked-in air, is adapted such that the moisture content in the exhaust air is controlled against a set value, which is as high as possible in view of the risk of condensation etc. The temperature of the exhaust air may, for example, be 100–130° C. and the water content thereof 0.15–0.30 kg/kg of dry air, and the corresponding temperature and water content of the supply air may, for example, be 75–105° C. and 0.005–0.03 kg/kg, respectively.

The process air is heated by supplying heat to the mixture of supply air and recirculated process air. This normally takes place by recuperative heat exchange wherein the heating medium is low-pressure steam or medium-pressure steam. In the case of an increased drying requirement, the supply of heat is increased and in the case of a reduced drying requirement, the supply of heat is decreased. The temperature of the process air is influenced in an upward direction by an increased supply of heat and in a downward direction by a reduced supply of heat. In the following this is described such that the temperature is controlled although this does not entail a direct control of the temperature which is influenced, inter alia, by the water content in the process air and the degree of recirculation.

Within the framework provided by a maximum moisture content in the exhaust air and a possible supply of heat in the recirculated process air, the aim is to use as small a volume flow as possible for the process air because the fans are driven by electric motors and electrical energy is much more expensive than thermal energy. In a pulp mill, the low-pressure steam is often available at practically no cost. The control is relatively slow and insensitive to variations in material quality.

When changing the grade of the web-formed material and upon start-up after a web break, the adjustment takes a relatively long time. This is largely due to the thermal inertia in the heating system.

OBJECTS OF THE INVENTION

It is a main object of the present invention to provide a simple method for monitoring and control of the moisture content of a web-formed material, primarily pulp, which is capable of reducing the time required for changing the conditions in, for example, the pulp manufacture. Thus, the intention is to minimize the risk of the dried web-formed material not fulfilling the specification given with regard to the dry content.

It is a second object of the present invention to provide a simple method of reducing the time interval during which the web-formed material does not fulfil the given specification after a web break or changes in the grade, thus reducing the produced quantity of inferior material, so-called broke.

SUMMARY OF THE INVENTION

The present invention relates to a method for controlling drying of a web-formed material, preferably a pulp web. The web-formed material is passed through a drying plant, comprising blow boxes arranged in a plurality of drying decks, floating above lower blow boxes, which on their upper sides blow out hot process air against the web-formed material in order to dry the material. Water, in the form of steam, escaping from the web-formed material is mixed with and discharged by the process air, at least part of which is recirculated whereas the non-recirculated process air is discharged as exhaust air and is replaced by a corresponding portion of supply air, preferably hot air with a low water content. The temperature of the process air is controlled.

In the method according to the invention, upon a detected deviation from the desired dry content of the dried web-formed material, the volume flow of the process air is changed by increasing the volume flow of the process air, at too low a dry content in the web-formed material, and by reducing the volume flow of the process air at too high a dry content, for the purpose of rapidly regaining the desired dry content of the dried, web-formed material.

GENERAL DESCRIPTION OF THE INVENTION

The inventive concept is based on the realization that control of recuperative supply of heat will always be connected with a relatively long time constant. From the point in time at which a change is initiated until stationary conditions prevail again, several minutes may pass, perhaps even up to half an hour. During this period, the quality of, for example, a pulp web cannot be expected to be within the given limits of the current specification. This may also lead to problems when cutting and during storage.

To solve this problem, it is proposed according to the present invention, instead of conventionally controlling the contactless drying of a web-formed material, for example a pulp web with varied heating of the process air by means of a heat exchanger, to use a considerably faster control of the volume flow for the process air that is supplied at the web-formed material for drying and supporting the web.

The fact that an increased volume flow of the process air results in increased drying power and a reduced volume flow results in reduced drying power, provided that the temperature in the process air is not changed significantly, is, per se, only a logical conclusion based on well-known physical relationships. The novelty of the invention resides in the unprejudiced realization that the conventional attitude that electricity costs more than steam heating should be briefly abandoned, and that, instead of trying to correct the moisture content of the material web by a primary measure far away from the material web, where heat is supplied to the process air, a change should be made close to the material web, and that the drying power should be increased or decreased by increasing or decreasing the volume flow of the process air. This change has an almost immediate effect. The supply of heat to the process air is then corrected upwards or downwards for the purpose of minimizing the cost of the drying. One condition for the proposed method is that the limit values to the capacity of the circulating fans or the process air flow that is required for a stable web run are not attained in normal operation.

In a preferred embodiment, the volume flow of the process air is changed by changing the speed of the circulating fans that supply the blow boxes with process air. The circulating fans are preferably driven by electric motors supplied with ac voltage. In this case, the speed of the circulating fans is suitably changed by controlling the frequency of the voltage supplied to the motors.

In currently used drying plants for pulp, air is normally supplied through the lower blow boxes in such a way that the web-formed material is maintained at a stable floating position above the lower blow boxes, whereas process air is blown through upper blow boxes essentially vertically downwards against the upper side of the web-formed material.

In large drying plants, a plurality of circulating fans are usually used. In these cases, a lower blow box and the opposite upper blow box are preferably supplied with process air from the same circulating fan, suitably in such a way that each circulating fan supplies a group of adjacent lower and upper blow boxes with process air.

Within the scope of the invention, the same frequency can be chosen for the voltage that is supplied to the motors of all of the circulating fans. However, it sometimes proves to entail definite advantages to select, individually or in groups, the frequency of the voltage that is supplied to the motors of the circulating fans such that it is adapted to the requirement that is known by experience, the least energy consumption, the desired grade of the dried web-formed material, or the like.

In a preferred embodiment, the frequency of the voltage that is supplied to the motors of the circulating fans is chosen depending on where in the drying process the circulating fan in question supplies blow boxes with process air, preferably such that the frequency is higher for circulating fans near the inlet of the drying plant than near the outlet thereof. If a deviation from the desired dry content of the web-formed material is detected, the frequency of the voltage that is supplied to the motors of the circulating fans is then suitably changed by a magnitude which is dependent on the frequency in question, for the fan or group of fans in question, when the deviation is detected.

The great advantage of the invention resides in the control at rapid changes, such as change of the produced grade or start-up after a web break.

BRIEF DESCRIPTION OF THE DRAWINGS

The invention will now be explained in greater detail with reference to the accompanying drawings, wherein FIG. 1 schematically shows a detailed view of a device suitable for carrying out the method according to the invention.

DESCRIPTION OF THE PREFERRED EMBODIMENTS

Figure 1:
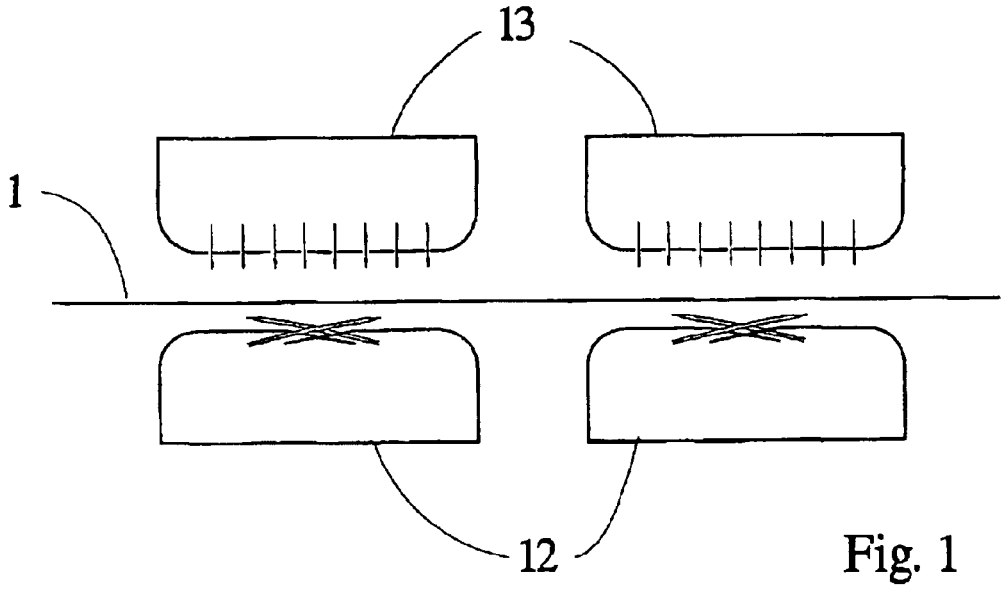

FIG. 1 shows the main principle of contactless drying. A pulp web 1 is passed between lower blow boxes 12 which at their upper sides blow out how air against the pulp web 1, and upper blow boxes 13 which at their lower sides blow out hot air against the pulp web 1. The lower blow boxes 12 blow at least part of the air tangentially along the upper side of the blow box 12 to provide a stable floating height for the web above the lower blow boxes 12. The upper blow boxes 13 blow the air essentially perpendicular to the web 1.

Figure 2:
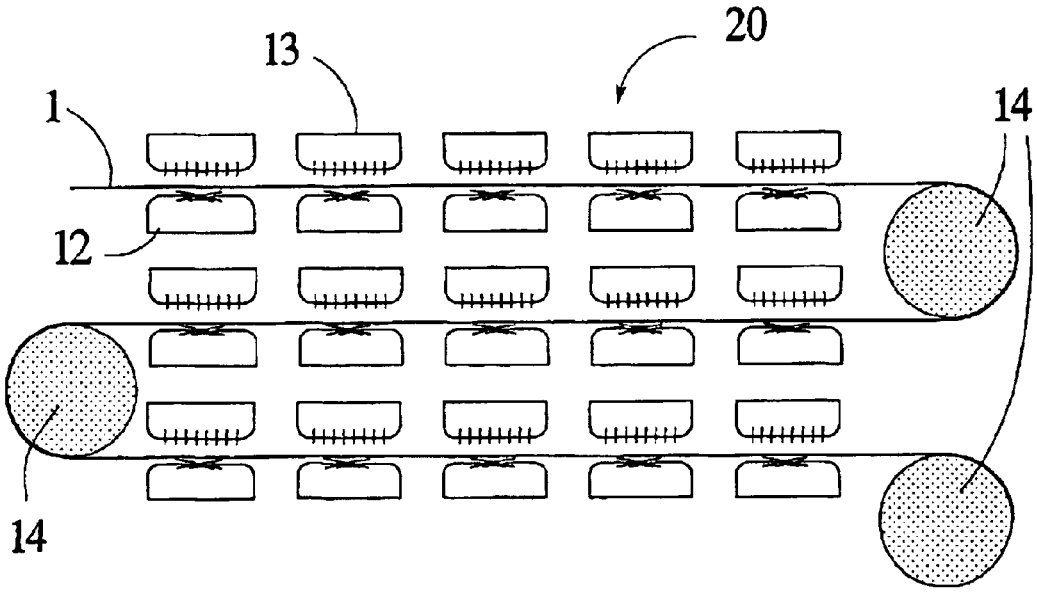
FIG. 2 schematically shows a drying section suitable for carrying out the method according to the invention.

FIG. 2 shows a simplified view of a drying section 20 comprising lower blow boxes 12 and upper blow boxes 13 according to the above. The blow boxes are arranged in three drying decks and the pulp web 1 is moved during the drying in a reciprocating movement through the drying section 20. The direction is changed over turning rolls 14 between the drying decks.

Figure 3:
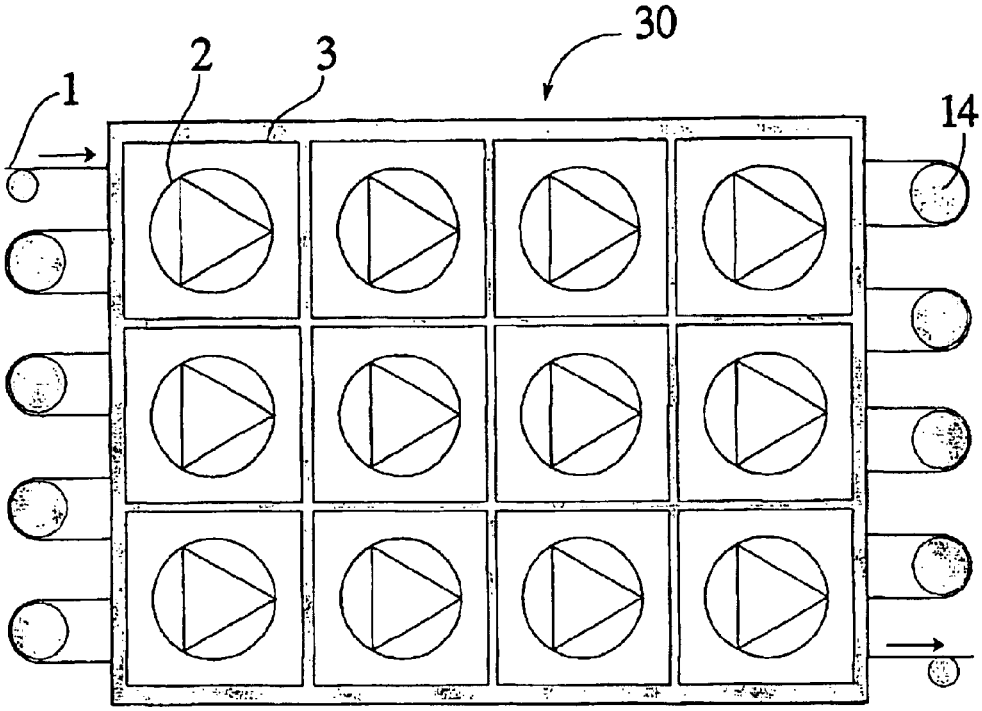
FIG. 3 schematically shows a side view of a drying plant suitable for carrying out the method according to the invention.

FIG. 3 shows a simplified side view of a drying plant 30 for a pulp web 1. The drying plant 30 comprises nine drying decks with eight intermediate turning rolls 14. The blow boxes 12, 13 in the nine drying decks are supplied with process air by twelve fans 2 arranged in three horizontal rows. Each fan 2 supplies a group 3 of blow boxes 12, 13, with a location corresponding to that of the fan 2 in the side view, with heated process air.

Figure 4:
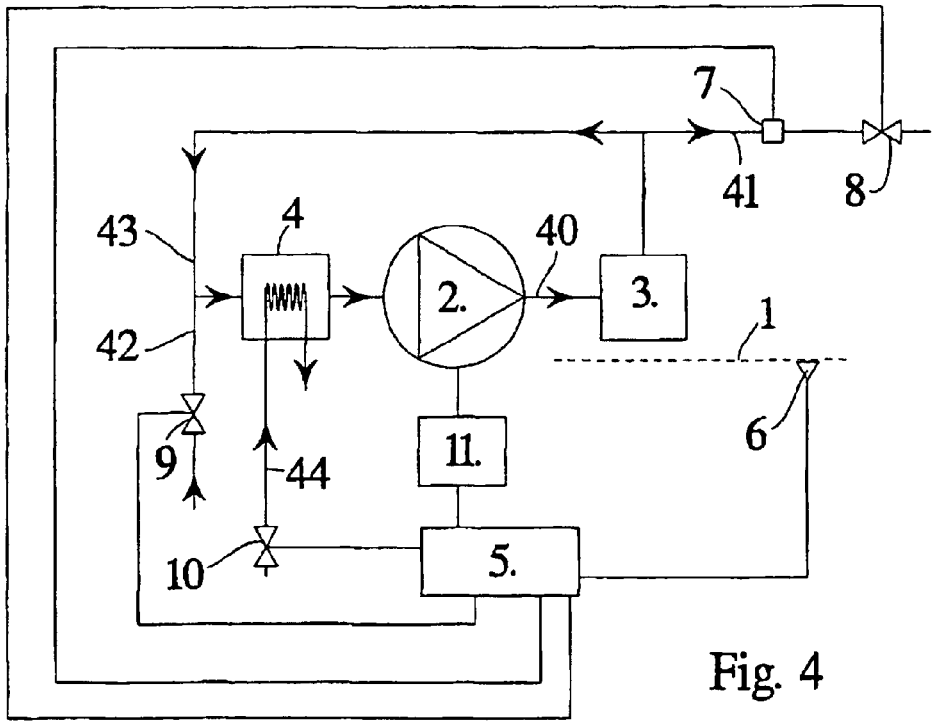
FIG. 4 schematically shows a flow and signal-processing diagram suitable for the method according to the invention.

FIG. 4 shows a simplified flow diagram for the process air and the associated signal processing according to the invention. The diagram exhibits a circulating fan 2 for process air, a heat exchanger 4 for heating the process air upstream of the circulating fan 2, and a group 3 of blow boxes 12, 13 which are supplied with process air by the circulating fan 2.

A control unit 5 monitors the drying via a measuring sensor 6 for the dry content in the dried pulp web 1 and a measuring sensor 7 for the water content in the exhaust air in an exhaust-air channel 41. The control unit controls the drying via a control device 8 for exhaust air in the exhaust-air channel 41, a control device 9 for supply air in a supply-air channel 42, and a control device 10 for low-pressure steam in a conduit 44, to the heat exchanger 4, and by controlling the frequency of the ac voltage that is fed to the circulating fan 2 via a frequency converter 11. In this way, the recirculation flow, through a channel 43, mixed with the supply-air flow, through the channel 42, to the common process-air flow, through the heat-exchanger 4 and the circulating fan 2, is controlled.

The control unit 5 is common to the whole drying plant 30 (in FIG. 3) whereas the number of frequency converters 11 may suitably be larger. One frequency converter 11 may be used separately for each fan 2, but for practical reasons it may be preferable to have, for example, one frequency converter 11 for each horizontal row of fans 2, which entails three frequency converters 11 in the embodiment according to FIG. 3. A division of the fans 2 into groups for several frequency converters 11 should be made such that the groups, with respect to flow of the pulp web 1, do not overlap each other.

In stationary operation, the moisture content in the dried paper web is registered by the control unit 5 via the sensor 6, and the quantity of low-pressure steam, passed to the heat exchanger 4 via the conduit 44 and the control device 10, is controlled so as to obtain a desired value for the dry content of the pulp web 1. The exhaust-air flow via the channel 41 is adjusted by the control device 8 so that a desired value of the water content in the exhaust air in the exhaust-air channel 41 is measured by the measuring sensor 7. The supply-air flow in the supply-air channel 42 is adjusted by the control device 9 so that the air pressure in the drying plant 30 achieves the desired value. The speed of the fan 2 is maintained as low as possible, in accordance with the established strategy, in order to minimize the consumption of electrical energy.

At an increase of the moisture content, or at too high a value from a general point of view, for the dried pulp web 1, registered by the measuring sensor 6, the control unit 5 increases the speed of the circulating fan 2 for the process air via the frequency converter 11. The volume flow of the process air, at the outlet 40 of the fan 2, is increased and in this way an increased drying power is obtained. The desired moisture content of the dried pulp web is obtained again relatively rapidly. This rapid recovery reduces the production of pulp outside the specification at the cost of a briefly increased energy consumption.

At the same time, as a result of the fact that the frequency of the ac voltage, which drives the motor for the circulating fan 2 in question, is higher that the desired frequency, the control unit 5 provides, via the control device 11, an increased steam flow to the heat exchanger 4 and concurrently with this relatively slowly providing an increased heat transfer to the process air, the frequency of the ac voltage is corrected, resulting in a decreasing flow of the process air since the moisture content of the pulp web 1 will lie below the specified one. This continues until the frequency of the ac voltage again has reached the predetermined value.

During this process, the flow of exhaust air is automatically corrected. Any increase of the water content in the exhaust air is compensated for by the control unit 5 by the flow of exhaust air being increased to a corresponding degree by the control device 8 in the exhaust-air channel 41. The supply-air flow through the supply-air channel 42 is changed by the control unit 5 so as to essentially follow the exhaust-air flow in order for the air pressure in the drying plant 30 to be maintained unchanged. When the steam content/moisture content of the exhaust air reaches a predetermined value and the frequency of the ac voltage is the desired one, the operation will be stationary again. The lasting change is, as a consequence of the relatively slowly proceeding change of the steam supply, an increase of the supply of heat corresponding to the increased drying requirement.

At a sudden reduction of the moisture content in the dried pulp web 1, the process takes place in the reverse direction.

ALTERNATIVE EMBODIMENTS

The invention is not, of course, limited to the embodiments described above but may be varied in a plurality of ways within the scope of the following claims. Thus, for example, non-linear control means, such as integrating means, differentiating means, or combinations thereof, and/or complicated control algorithms may be used.

Further, the basic concept of the invention may be applied also when using other types of blow boxes, for example without a stable web run.

In the above description, corrective measures are assumed to be due to an unforeseen disturbance. The invention is, of course, equally applicable when it is desired to actively change the drying, for example due to a changed specification.

What is claimed is:

1. A method for controlling drying of a web-formed material moving through a drying plant having a plurality of upper and lower blow boxes arranged in a plurality of drying decks, the web-formed material floating above the lower blow boxes, which at their upper sides blow out hot process air against the web-formed material, thereby drying the web-formed material, comprising:

detecting water content in the web-formed material downstream of the blow boxes;

blowing process air on the web-formed material, wherein water escaping from the web-formed material is mixed with and discharged by the process air;

re-circulating at least part of the process air, whereas the a non-circulated part of the process air is discharged as exhaust air, replacing the discharged exhaust air with a corresponding portion of supply air controlling the temperature of the process air, determining a deviation from a desired water content of the dried web-formed material by comparing the desired water content to the sensed water content;

changing the volume flow of the process air in accordance with the deviation, whereby the volume flow of the process air is increased when the water content in the web-formed material is too high, and the volume flow of the process air is decreased when the water content in the web-formed material is too low, thereby rapidly regaining the desired water content of the dried web-formed material.

2. A method according to claim 1, wherein the step of changing the volume flow of the process air comprises changing the speed of circulating fans which supply the blow boxes with process air.

3. A method according to claim 2, wherein the circulating fans are driven by electric motors supplied by ac voltage, and wherein the step of changing the volume flow of process air comprises changing the speed of the circulating fans by controlling the frequency of the ac voltage which is fed to the motors.

4. A method according to claim 3, further comprising blowing the process air through the upper blow boxes essentially vertically downwards against the upper side of the web-formed material.

5. A method according to claim 4, wherein the drying plant includes at least two circulating fans, and wherein a lower blow box and an opposite upper blow box are supplied with process air from the same circulating fan.

6. A method according to claim 5, wherein each circulating fan supplies a group of adjacent lower and upper blow boxes with process air.

7. A method according to claim 6, wherein the same frequency is chosen for the ac voltage that is fed to the motors of all of the circulating fans.

8. A method according to claim 6, wherein the frequency of the ac voltage that is fed to the motors of the circulating fans is chosen depending on where in the drying process the circulating fan in question supplies blow boxes with process air, whereby the frequency is higher for circulating fans near the inlet of the drying plant than near the outlet thereof, wherein if a deviation from the desired dry content of the dried web-formed material is detected, the method further comprises changing the frequency of the ac voltage that is fed to the motors of the circulating fans by a magnitude which is dependent on the actual frequency when the deviation is detected.

9. A method according to claim 1, further comprising supplying the process air through the lower blow boxes, whereby the web-formed material is maintained in a stable floating position above the lower blow boxes.

10. A method according to claim 1, wherein an initial volume flow of process air corresponds to a frequency of the ac voltage that is fed to the motors of the circulating fans and is selected by one of empirical data, the least energy consumption, and the desired grade of the dried web-formed material.

11. A method according to claim 1, wherein the web-formed material is a pulp web.

12. A method for controlling the moisture content of a web-formed material comprising the steps of:

moving the web-formed material through a drying section;

supplying the drying section with process air at a predetermined flow rate selected to dry the web-formed material sufficiently to achieve a desired moisture content;

sensing moisture content of the web-formed material as it leaves the drying section;

determining deviations from the desired moisture content based on a difference between the desired moisture content and the sensed moisture content;

changing the flow rate of the process air in accordance with the deviations from the desired moisture content, such that the flow rate is increased when the deviation is such that the sensed moisture content is higher than the desired moisture content, and the flow rate is decreased when the deviation is such that the sensed moisture content is lower than the desired moisture content; and increasing the temperature of the process air when the flow rate is increased, thereby increasing the drying capabilities of the process air, and decreasing the flow rate of the process air as the sensed moisture content decreases.

* * * * *